US008903281B2

(12) United States Patent
Koido

(10) Patent No.: US 8,903,281 B2
(45) Date of Patent: Dec. 2, 2014

(54) IMAGE FORMING APPARATUS INCLUDING AN IMAGE FORMING UNIT WITH WHITE DEVELOPER

(71) Applicant: Oki Data Corporation, Tokyo (JP)

(72) Inventor: Kenji Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 51 days.

(21) Appl. No.: 13/624,298

(22) Filed: Sep. 21, 2012

(65) Prior Publication Data

US 2013/0078001 A1 Mar. 28, 2013

(30) Foreign Application Priority Data

Sep. 22, 2011 (JP) ..... 2011-207527

(51) Int. Cl.
*G03G 15/01* (2006.01)
*G03G 15/20* (2006.01)
*G03G 15/00* (2006.01)

(52) U.S. Cl.
CPC .. *G03G 15/6585* (2013.01); *G03G 2215/00717* (2013.01)
USPC ..... 399/223; 399/321

(58) Field of Classification Search
USPC ..... 399/223, 231, 298, 321; 430/107.1, 430/108.1
See application file for complete search history.

(56) References Cited

U.S. PATENT DOCUMENTS

2011/0183247 A1* 7/2011 Kadokura et al. ..... 430/105

FOREIGN PATENT DOCUMENTS

| | | |
|---|---|---|
| JP | 2002-108038 | 4/2002 |
| JP | 2002-236396 A | 8/2002 |
| JP | 2002-287400 | 10/2002 |
| JP | 2003-186344 | 7/2003 |
| JP | 2006-58869 | 3/2006 |
| JP | 2009-134060 | 6/2009 |

* cited by examiner

*Primary Examiner* — Hoang Ngo
(74) *Attorney, Agent, or Firm* — Rabin & Berdo, P.C.

(57) ABSTRACT

An image forming apparatus includes a first image forming unit configured to form a white developer image on a recording medium using a white developer, at least one second image forming unit configured to form at least one single-color developer image on the recording medium using at least one single-color developer other than the white developer, and a fixing unit configured to fix the white developer image and the at least one single-color developer image to the recording medium so as to form a white image and at least one single-color image. The white image may have a haze value that is higher than that of the at least one single-color image. The white developer may have a softening temperature that is higher than that of the at least one single-color developer.

26 Claims, 7 Drawing Sheets

| | S1 | S2 | S3 | S4 |
|---|---|---|---|---|
| TEST PATTERN 1 | W | Y | M | C |
| TEST PATTERN 2 | K | R | G | B |
| TEST PATTERN 3 | | W+Y | W+M | W+C |
| TEST PATTERN 4 | W+K | W+R | W+G | W+B |

W= WHITE TONER 100%
Y= YELLOW TONER 100%
M= MAGENTA TONER 100%
C= CYAN TONER 100%
K= BLACK TONER 100%
R= YELLOW TONER 100% + MAGENTA TONER 100%
G= YELLOW TONER 100% + CYAN TONER 100%
B= MAGENTA TONER 100% + CYAN TONER 100%
W+$\alpha$= WHITE TONER 100% (LOWERMOST LAYER) + $\alpha$(Y-B)

FIG.3

| HAZE VALUE | |
|---|---|
| TONER | HAZE VALUE % |
| W | 88 |
| Y | 65 |
| M | 66 |
| C | 70 |
| K | 70 |
| R | 79 |
| G | 76 |
| B | 78 |
| W+Y | 89 |
| W+M | 90 |
| W+C | 88 |
| W+K | 89 |
| W+R | 91 |
| W+G | 91 |
| W+B | 91 |

TEST 1

FIG.4

| PRINTING HUE ON TRANSPARENT FILM (PLACED ON BLACK BASE SHEET) | | | |
|---|---|---|---|
| TONER | L* | a* | b* |
| W | 81.7 | -1.6 | -3.9 |
| Y | 40.4 | -16.7 | 36.9 |
| M | 20.5 | 24.1 | -1.5 |
| C | 18.6 | -8.3 | -17.8 |
| K | 9.5 | -0.9 | -1.0 |
| R | 23.0 | 30.6 | 17.5 |
| G | 22.8 | -39.0 | 10.3 |
| B | 9.3 | 6.3 | -19.3 |
| W+Y | 78.9 | -10.7 | 88.3 |
| W+M | 40.8 | 62.5 | -3.4 |
| W+C | 42.7 | -22.7 | -49.5 |
| W+K | 12.4 | -0.6 | -1.1 |
| W+R | 40.3 | 58.7 | 42.0 |
| W+G | 37.3 | -66.1 | 22.5 |
| W+B | 16.3 | 14.3 | -39.0 |
| BASE SHEET | 26.7 | 0.4 | 1.0 |

TEST 1

| PRINTING HUE ON TRANSPARENT FILM (PLACED ON BLUE BASE SHEET) | | | |
|---|---|---|---|
| TONER | L* | a* | b* |
| W | 85.0 | -2.9 | -5.0 |
| Y | 61.9 | -24.9 | 64.4 |
| M | 31.3 | 47.8 | -25.5 |
| C | 41.3 | -27.5 | -47.8 |
| K | 11.1 | -2.7 | -2.8 |
| R | 30.9 | 43.1 | 29.0 |
| G | 33.6 | -63.8 | 22.0 |
| B | 13.8 | 19.3 | -44.1 |
| W+Y | 81.0 | -11.9 | 91.7 |
| W+M | 41.6 | 64.5 | -3.2 |
| W+C | 43.9 | -23.2 | -51.5 |
| W+K | 11.7 | -2.3 | -1.7 |
| W+R | 40.9 | 60.7 | 43.6 |
| W+G | 38.4 | -68.7 | 23.9 |
| W+B | 17.2 | 15.4 | -39.6 |
| BASE SHEET | 64.9 | -12.3 | -22.5 |

TEST 1

TEST 1

| HAZE VALUE | |
|---|---|
| TONER | HAZE VALUE % |
| W | 70 |
| W+Y | 80 |
| W+M | 81 |
| W+C | 78 |
| W+K | 78 |
| W+R | 79 |
| W+G | 79 |
| W+B | 79 |

TEST 2

| PRINTING HUE ON TRANSPARENT FILM (PLACED ON BLACK BASE SHEET) | | | |
|---|---|---|---|
| TONER | L* | a* | b* |
| W | 63.5 | -2.1 | -3.9 |
| W+Y | 62.1 | -13.5 | 49.1 |
| W+M | 27.0 | 38.2 | -2.6 |
| W+C | 32.3 | -15.5 | -31.4 |
| W+K | 10.0 | -0.6 | -1.1 |
| W+R | 31.9 | 39.9 | 30.2 |
| W+G | 30.0 | -50.7 | 14.9 |
| W+B | 10.9 | 9.9 | -29.0 |

TEST 2

TEST 2

| PRINTING HUE ON BLUE SHEET (PLACED ON BLUE BASE SHEET) | | | |
|---|---|---|---|
| TONER | L* | a* | b* |
| W | 81.8 | -5.0 | -8.3 |
| Y | 63.9 | -26.4 | 63.7 |
| M | 32.0 | 45.2 | -18.6 |
| C | 41.3 | -20.5 | -48.2 |
| K | 11.0 | -4.2 | -1.6 |
| R | 29.5 | 40.7 | 28.5 |
| G | 34.2 | -63.4 | 22.8 |
| B | 14.0 | 19.2 | -44.3 |
| W+Y | 78.3 | -15.3 | 80.6 |
| W+M | 41.1 | 59.1 | -6.0 |
| W+C | 45.9 | -22.2 | -49.5 |
| W+K | 12.1 | -1.5 | -3.5 |
| W+R | 39.7 | 57.4 | 39.2 |
| W+G | 39.6 | -64.6 | 21.5 |
| W+B | 17.3 | 15.0 | -21.8 |

TEST 4

TEST 4

IMAGE FORMING APPARATUS INCLUDING AN IMAGE FORMING UNIT WITH WHITE DEVELOPER

BACKGROUND OF THE INVENTION

The present invention relates to an image forming apparatus using electrophotography.

There is proposed an image forming apparatus capable of making a color of a recording medium (beneath a toner image) less visible. Such an image forming apparatus is configured to form a white toner image on the recording medium, to form a color toner image on the white toner image, and to fix the toner images to the recording medium (see, for example, Japanese Laid-open Patent Publication No. 2002-236396).

However, if the white toner image has a high optical transparency, the color of the recording medium (beneath the white toner image) may still be visible. Therefore, the color toner image is influenced by the color of the recording medium.

SUMMARY OF THE INVENTION

An aspect of the present invention is intended to provide an image forming apparatus capable of forming an image which is less likely to be influenced by a color of a recording medium.

According to an aspect of the present invention, there is provided an image forming apparatus including a first image forming unit configured to form a white developer image on a recording medium using a white developer, at least one second image forming unit configured to form at least one single-color developer image on the recording medium using at least one single-color developer other than the white developer, and a fixing unit configured to fix the white developer image and the at least one single-color developer image to the recording medium so as to form a white image and at least one single-color image. A haze value of the white image is higher than a haze value of each of the at least one single-color image.

With such a configuration, it becomes possible to provide an image forming apparatus capable of forming an image which is less likely to be influenced by a color of a recording medium.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIG. 3 is a table showing haze values measured in Test 1;

FIG. 4 is a table showing printing hues of developers printed on a transparent film placed on a black base sheet in Test 1 which are expressed as values on a (L*, a*, b*) color coordinate system;

DETAILED DESCRIPTION OF THE PREFERRED EMBODIMENT

Figure 1:
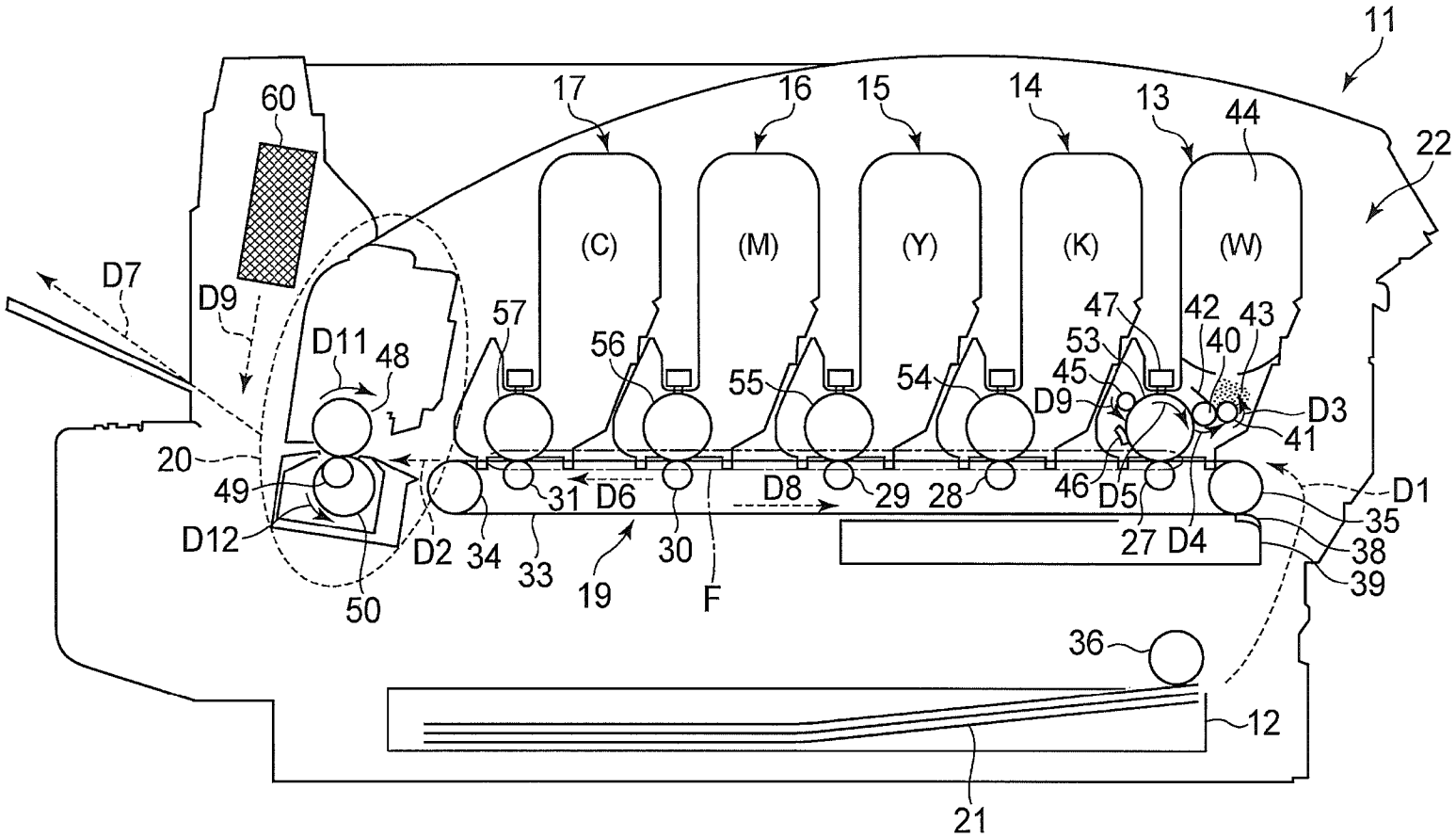
FIG. 1 is a schematic view showing a configuration of a printer as an image forming apparatus according to Embodiment 1 of the present invention.

Hereinafter, embodiments of the present invention will be described with reference to drawings. The drawings are provided for illustrative purpose and are not intended to limit the scope of the present invention. In respective drawings, common or similar components or are denoted by the same reference numerals.

First Embodiment

Configuration of First Embodiment

<Printer 11>

FIG. 1 is a schematic view showing a printer 11 as an image forming apparatus according to the first embodiment of the present invention. The printer 11 is configured as, for example, a color printer using electrophotography. The printer 11 includes a medium cassette 12, an image forming portion 22 including image forming units 13, 14, 15, 16 and 17, a transfer unit 19, and a fixing unit 20.

The medium cassette 12 (i.e., a medium storage portion) is configured to store a stack of media 21 (also referred to as printing media, recording media or transfer materials) such as papers. The medium cassette 12 is detachably mounted to a lower part of the printer 11. A feeding roller 36 (i.e., a feeding mechanism) is provided so as to contact a surface of the uppermost medium 21 of the stack placed on the medium cassette 12. The media 21 stored in the medium cassette 12 are drawn out one by one by the feeding roller 36, and are conveyed in a direction indicated by an arrow D1 along a medium guide toward the image forming portion 22.

The image forming portion 22 includes the image forming units 13, 14, 15, 16 and 17 which are arranged in series along a medium conveying path and are detachably mounted. The image forming units 13, 14, 15, 16 and 17 form developer images (also referred to as toner images). The developer images are transferred onto an upper surface (i.e., a printing surface) of the medium 21 by the transfer unit 19. The image forming units 13, 14, 15, 16 and 17 have the same configurations except the colors of the toners. The image forming units 13, 14, 15, 16 and 17 use a white (W) toner, a black (K) toner, a yellow (Y) toner, a magenta (M) toner and a cyan (C) toner. In this regard, the number of the image forming units and the kinds of the toners are not limited to this example.

The transfer unit 19 includes a transfer belt 33 that electrostatically absorbs and conveys the medium 21, a drive roller 34 rotated by a driving source to move the transfer belt 33, and a tension roller 35 paired with the drive roller 34. The transfer belt 33 is stretched around the drive roller 34 and the tension roller 35. The transfer unit 19 further includes transfer rollers 27, 28, 29, 30 and 31 which are respectively pressed against photosensitive drums 53, 54, 55, 56 and 57 of the image forming units 13, 14, 15, 16 and 17. The transfer rollers 27, 28, 29, 30 and 31 are applied with transfer voltages to thereby transfer the toner images from the photosensitive drums 53, 54, 55, 56 and 57 to the medium 21. The transfer unit 19 further includes a transfer belt cleaning blade 38 that scrapes off the toner from the transfer belt 33 to thereby clean the transfer belt 33, and a waste toner tank 39 for storing the toner scraped off by the transfer belt cleaning blade 38.

<Image Forming Unit 13>

Next, the image forming unit 13 using the white (W) toner will be described. In this regard, the image forming unit 14 using the black (K) toner, the image forming unit 15 using the yellow (Y) toner, the image forming unit 16 using the magenta (M) toner and the image forming unit 17 using the cyan (C) toner have the same configurations as the image forming unit 13 except the kinds (colors) of the toners.

The image forming unit 13 includes the above described photosensitive drum 53 as a latent image bearing body. The image forming unit 13 further includes a charging roller 45 as a charging member, a developing roller 40 as a developer bearing body, a supply roller 41 as a developer supply-and-collection body, a developing blade 42 as a developer layer regulating body, a toner cartridge 44 as a developer storage body for storing the toner 43, and a cleaning blade 46 as a developer removing member.

The photosensitive drum 53 includes a conductive supporting body and a photoconductive layer formed on an outer circumferential surface of the conductive supporting body. The conductive supporting body is formed of, for example, a metal pipe of aluminum. The photoconductive layer has, for example, a structure in which a charge generation layer and a charge transport layer are laminated.

The charging roller 45 is provided in contact with an outer circumferential surface of the photosensitive drum 53. The charging roller 45 is formed of, for example, a metal shaft and a photoconductive epichlorohydrin rubber formed on an outer circumferential surface of the metal shaft.

An LED head 47 as an exposure device is provided above the photosensitive drum 53 so as to face the photosensitive drum 53. The LED head 47 includes, for example, a plurality of LEDs (Light Emitting Diodes) and a lens array. The LEDs emit lights which are focused on the outer circumferential surface of the photosensitive drum 53. In this regard, it is also possible to use other light source (for example, a laser light emitting element) than LEDs.

The developing roller 40 is provided in contact with the outer circumferential surface of the photosensitive drum 53. The developing roller 40 is formed of, for example, a metal shaft and a semiconductive urethane rubber formed on an outer circumferential surface of the metal shaft.

The developing blade 42 is provided in contact with the outer circumferential surface of the developing roller 40. The developing blade 42 is formed of a plate spring made of a stainless steel, a phosphor bronze or the like. The developing blade 42 is configured to regulate a thickness of a developer layer (i.e., a toner layer) on the surface of the developing roller 40.

The developing roller 40 develops the latent image on the photosensitive drum 53 using the white toner, and the white toner image is formed on the photosensitive drum 53. The white, black, yellow, magenta and cyan toner images respectively formed on the photosensitive drums 53, 54, 55, 56 and 57 of the image forming units 13, 14, 15, 16 and 17 are transferred to the medium 21 conveyed by the transfer belt 33.

The medium 21 with the transferred toner images is further conveyed by the transfer belt 33 to the fixing unit 20. The fixing unit 20 includes, for example, a fixing roller (also referred to as a heating roller) 48, a pressure roller 49 and a pressure belt 50. The fixing unit 20 fixes the toner images (i.e., a white toner image and color toner images) to the medium 21 by application of heat and pressure.

In this regard, the image forming unit 13 corresponds to a first image forming unit that forms a white toner image on the medium 21. The image forming units 14 through 17 correspond to second image forming units that form a color toner image (described later) on the white toner image. A region of the transfer belt 33 facing the image forming 13, 14, 15, 16 and 17 is referred to as a facing region F.

<Toner 43>

Next, a toner 43 as a developer will be described. The toner 43 includes mother particles containing at least binder resin, and inorganic fine powder or organic fine powder. The inorganic fine powder or organic fine powder is added to the mother particles by, for example, surface treatment. The binder resin is, for example, polyester resin, acrylic-styrene resin, epoxy resin, styrene-butadiene resin or the like.

The toner is manufactured by arbitrarily adding known component such as a coloring agent, a releasing agent, a charge control agent, a processing agent or the like to the binder resin by mixing or by surface treatment.

As for the coloring agent, a pigment, dye and or like generally used as the coloring agent for black, yellow, magenta and cyan toner may be used singly, or a plurality of kinds may be used in combination. For example, carbon black, iron oxide, permanent brown FG, pigment green B, pigment blue 15:3, solvent blue 35, solvent red 49, solvent red 146, quinacridone, carmine 6B, naphthol, disazo yellow, isoindoline or the like may be used as the coloring agent. An adding amount of the coloring agent added to the binder resin is preferably in a range of 2-25 weight parts with respect to 100 weight parts of the binder rein, and more preferably in a range of 2-15 weight parts with respect to 100 weight parts of the binder resin.

As for the coloring agent of the white toner, for example, titanium oxide may be used. The titanium oxide may be subjected to surface treatment, or a plurality of kinds may be use in combination. An adding amount of the coloring agent is preferably in a range of 20-100 weight parts with respect to 100 weight parts of the binder resin, and is more preferably in a range of 50-100 weight parts with respect to 100 weight parts of the binder resin.

In this embodiment, the titanium oxide is used as the coloring agent of the white toner. However, it is also possible to use other metallic oxide (for example, aluminum oxide) as the coloring agent.

As for the releasing agent, for example, a low molecular weight polyethylene, a low molecular weight polypropylene, a paraffin wax, a carnauba wax or the like may be used. A content of the releasing agent is preferably in a range of 0.1-20 weight parts with respect to 100 weight parts of the binder resin, and is more preferably in a range of 0.5-12 weight parts with respect to 100 weight parts of the binder resin. Further, a plurality of kinds of waxes may be used in combination.

As for the charge control agent, a quaternary ammonium salt charge control agent or the like may be used for a positively chargeable toner. An azo based complex charge control agent, a salicylic acid based complex charge control agent, a calixarene based charge control agent or the like may be used for a negatively chargeable toner. The content of the charge control agent is preferably in a range of 0.05-15 weight parts with respect to 100 weight parts of the binder resin, and more preferably in a range of 0.1-10 weight parts with respect to 100 weight parts of the binder resin.

The processing agent is added for enhancing environmental stability, charging stability, developing property, fluidity, preserving property or the like. For example, silica, titania, alumina or the like may be used as the processing agent. A content of the processing agent is preferably in a range of 0.01-10 weight parts with respect to 100 weight parts of the binder resin, and is more preferably in a range of 0.05-8 weight parts with respect to 100 weight parts of the binder resin.

<White Toner>

The white toner used in the first embodiment will be described. First, 100 weight parts of polyester resin as the binder resin, 1.0 weight parts of "Bontron E-84" (manufactured by Orient Chemical Industry Co., Ltd.) as the charge control agent, 95 weight parts of titanium oxide as the coloring agent, 4.0 weight parts of "Carnauba Wax type 1" (manufactured by S. Kato & Co.) as the releasing agent were mixed using a Henschel mixer. The resulting material was molten and kneaded using a twin-type screw extruder. The resulting material was cooled, and crushed using a cutter mill having a screen with a diameter of 2 mm. The resulting material was pulverized using an impact plate type pulverizing machine, and was classified using a wind force classifier. As a result, toner mother particles were obtained.

Next, an external adding process was performed. In this process, 3.0 weight parts of hydrophobic silica "R972" (manufactured by Nippon Aerosil Co. Ltd.) with a mean particle diameter of 16 nm was added to 100 weight parts of the toner mother particles. The resulting material was agitated using the Henschel mixer for 3 minutes, with the result that a white toner with a mean volume diameter of 7.0 μm was obtained. This white toner is referred to as a "white toner 1".

The mean volume diameter of the white toner 1 was measured using a particle size distribution measuring apparatus ("Coulter Multisizer 3" manufactured by Beckmann Coulter Inc.) with an aperture diameter of 100 μm.

A hue in a powder state (referred to as a powder hue) of the white toner 1 was measured. The measured powder hue expressed in a (L*, a*, b*) color system was as follows: L*=94.64, a*=−1.25, and b*=2.94. The powder hue was measured using a spectral color-difference meter "SE-2000" (manufactured by Nippon Denshoku Industries Co., Ltd.) with a light source at a view field angle of 2 degree. The powder hue was measured by putting 5.0 g of the toner into a powder measurement cell of the spectral color-difference meter.

Further, a loose apparent density of the white toner 1 was measured. The measured loose apparent density of the white toner 1 was 0.60 g/cm$^3$. The loose apparent density of the toner was measured using "Powder Tester PT-S" (manufactured by Hosokawa Micron Corp.) having a sieve with a mesh size of 710 μm and having a measuring cup of 100 cc.

The white toner 1 had the following thermal properties: a softening temperature Tsw of 81° C., an outflow starting temperature Tfw of 98° C., and a melting temperature Tmw of 151° C.

The softening temperature Ts, the outflow starting temperature Tf, and the melting temperature Tm (i.e., the thermal properties of the toner) were measured using a flow characteristics evaluation instrument "CFT-500D" (manufactured by Shimadzu Corp.). The instrument has a die with a diameter of 1.0 mm and a length of 1.0 mm. The toner of 1.0 g is set in the instrument, a load of 10 kg is applied to the toner, and a temperature is raised from a starting temperature of 50° C. A preheating time period is 300 seconds, and a rate of temperature increase is 3° C./min. A rheogram curve obtained by the measurement provides the thermal properties. The softening temperature Ts is a temperature at which inner spaces of the toner disappear and the toner is brought into a uniform phase. The outflow starting temperature Tf is a temperature at which the toner is brought into a fluidized state. The melting temperature Tm is a temperature calculated by ½ method.

<Cyan Toner>

The cyan toner used in the first embodiment will be described. The cyan toner was manufactured using polyester resin (as the binder resin) having different thermal properties from those of the white toner 1. First, 100 weight parts of the binder resin, 0.5 weight parts of "Bontron E-84" (manufactured by Orient Chemical Industry Co., Ltd.) as the charge control agent, 4.0 weight parts of "Pigment Blue 15:3" as the coloring agent, 4.0 weight parts of "Carnauba Wax type 1" (manufactured by S. Kato & Co.) as the releasing agent were mixed using the Henschel mixer. The resulting material was molten and kneaded using the twin-type screw extruder. The resulting material was cooled, and crushed using the cutter mill having the screen with a diameter of 2 mm. The resulting material was pulverized using the impact plate type pulverizing machine, and was classified using the wind force classifier. As a result, toner mother particles were obtained.

Next, the external adding process was performed. In the external adding process, 3.0 weight parts of hydrophobic silica "R972" (manufactured by Nippon Aerosil Co. Ltd.) with a mean particle diameter of 16 nm was added to 100 weight parts of the toner mother particles. The resulting material was agitated using the Henschel mixer for 3 minutes, with the result that a cyan toner with a mean volume diameter of 7.0 μm was obtained. The loose apparent density of the cyan toner was measured. The measured loose apparent density was 0.35 g/cm$^3$. This cyan toner is referred to as a "cyan toner 1".

The cyan toner 1 had the following thermal properties: a softening temperature Tsc of 80° C., an outflow starting temperature Tfc of 94° C., and a melting temperature Tmc of 114° C.

The black toner, the magenta toner and the yellow toner were obtained using substantially the same manufacturing method as the manufacturing method of the cyan toner 1 by changing kinds of the coloring agents as follows.

<Black Toner>

The black toner was manufactured using carbon black as the coloring agent. A mean particle diameter of the black toner was 7.0 μm, and a loose apparent density was 0.35 g/cm$^3$. This black toner is referred to as a "black toner 1". The black toner 1 had the following thermal properties: a softening temperature Tsk of 80° C., an outflow starting temperature Tfk of 94° C., and a melting temperature Tmk of 114° C.

<Magenta Toner>

The magenta toner was manufactured using naphthol as the coloring agent. A mean particle diameter of the magenta toner was 7.0 μm, and a loose apparent density was 0.35 g/cm$^3$. This magenta toner is referred to as a "magenta toner 1". The magenta toner 1 had the following thermal properties: a softening temperature Tsm of 81° C., an outflow starting temperature Tfm of 95° C., and a melting temperature Tmm of 115° C.

<Yellow Toner>

The yellow toner was manufactured using isoindoline as the coloring agent. A mean particle diameter of the yellow toner was 7.0 μm, and a loose apparent density was 0.35 g/cm$^3$. This yellow toner is referred to as a "yellow toner 1". The yellow toner 1 had the following thermal properties: a softening temperature Tsy of 80° C., an outflow starting temperature Tfy of 94° C., and a melting temperature Tmy of 114° C.

The black toner, the cyan toner, the magenta toner and the yellow toner (i.e., toners other than the white toner) are collectively referred to as a "color toner".

In this embodiment, the printer 11 (i.e., the image forming apparatus) is configured to form a white toner image (i.e., a white developer image) on the medium 21 using the white toner (i.e., a white developer), and to form at least one of black, yellow, magenta and cyan toner images (i.e., at least one single-color developer image) using at least one of the black, yellow, magenta and cyan toners (i.e., at least one single-color developer) other than the white toner. The toner images are fixed to the medium 21, so that a white image and at least one of black, yellow, magenta and cyan images (i.e., at least one single-color image) are formed.

<Adhesion Amount of Toner>

In the first embodiment, the white toner has the outflow starting temperature Tf higher than a surface temperature Mt of the medium in a fixing process. Further, in the first embodiment, an adhesion amount of the color toner (i.e., each of the black, cyan, magenta and yellow toners) is preferably in a range of 0.4-0.6 mg/cm$^2$, and more preferably in a range of 0.4-0.5 mg/cm$^2$. Further, an adhesion amount of the white toner is preferably in a range of 0.8-1.1 mg/cm$^2$, and more preferably in a range of 0.9-1.1 mg/cm$^2$.

<<Operation of Printer>>

An operation of the printer 11 will be described. In the image forming unit 13, the photosensitive drum 53 is driven by a driving unit such as a motor to rotate at a constant speed in a direction indicated by an arrow D5 in FIG. 1. The charging roller 45 contacting the surface of the photosensitive drum 53 rotates in a direction indicated by an arrow D9, and applies a direct voltage (applied by a charging roller high voltage power source) to the surface of the photosensitive drum 53 so as to uniformly charge the surface of the photosensitive drum 53. The LED head 47 facing the photosensitive drum 53 emits light according to image signal so as to expose the surface of the photosensitive drum 53. Electric potential of the exposed part attenuates, and a latent image is formed on the surface of the photosensitive drum 53. The supply roller 41 is applied with a voltage by a supply roller high voltage power source and rotates in a direction indicated by an arrow D3. The supply roller 41 supplies the toner 43 to the developing roller 40.

The developing roller 40 tightly contacts the photosensitive drum 53, and is applied with a voltage by a developing roller high voltage power source. The developing roller 40 holds the toner 43 supplied by the supply roller 41, and carries the toner 43 in a direction indicated by an arrow D4. The developing blade 42 is pressed against the surface of the developing roller 40 at a downstream side with respect to the supply roller 41. The developing blade 42 scrapes off an excessive amount of the toner adhering to the surface of the developing roller 40 so as to form a thin toner layer on the surface of the developing roller 40.

A bias voltage is applied between the photosensitive drum 53 and the developing roller 40 by a high voltage power source. An electric field is generated between the developing roller 40 and the photosensitive drum 53 since the latent image is formed on the surface of the photosensitive drum 53. The charged toner on the surface of the developing roller 40 adheres to the latent image on the surface of the photosensitive drum 53 by an electrostatic force. Accordingly, the latent image is developed, and a toner image is formed. This developing process (beginning with the rotation of the photosensitive drum 53) starts at a predetermined timing.

As shown in FIG. 1, the medium 21 (for example, printing sheet) is fed from the medium cassette 12 by the feeding roller 36 in a direction indicated by the arrow D1 along the medium guide to reach the transfer unit 19. The above described image forming process starts at a predetermined timing while the medium 21 is conveyed in the direction indicated by the arrow D1.

The transfer roller 27 pressed against the photosensitive drum 53 via the transfer belt 33 is applied with a voltage by a transfer roller high voltage power source. The transfer roller 27 transfers the white toner image (formed on the photosensitive drum 53 in the developing process) onto the medium 21 electrostatically absorbed and conveyed by the transfer belt 33. This process is referred to as a transfer process.

Then, the medium 21 is conveyed by the transfer belt 33 in a direction (referred to as a medium conveying direction) indicated by an arrow D6. As the medium 21 is conveyed in the direction indicated by the arrow D6, the black toner image (i.e., a black developer image) is formed by the image forming unit 14, and is transferred onto the medium 21 by the transfer roller 28. The yellow toner image (i.e., a yellow developer image) is formed by the image forming unit 15, and is transferred onto the medium 21 by the transfer roller 29. The magenta toner image (i.e., a magenta developer image) is formed by the image forming unit 16, and is transferred onto the medium 21 by the transfer roller 30. The cyan toner image (i.e., a cyan developer image) is formed by the image forming unit 17, and is transferred onto the medium 21 by the transfer roller 31. The medium 21 to which the developer images of the respective colors are transferred is further conveyed in a direction indicated by an arrow D2.

The medium 21 is conveyed to the fixing unit 20 having the fixing roller 48, the pressure roller 49 and the pressure belt 50. A surface temperature of the fixing roller 48 is controlled to a predetermined surface temperature by a temperature control unit (not shown). The fixing roller 48 rotates in a direction indicated by an arrow D11, and a pressure roller 49 rotates in a direction indicated by an arrow D12. The medium 21 is fed between the fixing roller 48 and the pressure belt 50 pressed by the pressure roller 49 against the fixing roller 48. A heat of the fixing roller 48 causes the toner image on the medium 21 to be molten. The molten toner image is fixed to the medium 21 by being pressed by the fixing roller 48 and the pressure roller 49 via the pressure belt 50.

The medium 21 to which the toner image is fixed is conveyed in a direction indicated by an arrow D7, and is ejected outside the printer 11.

In each of the image forming units 13 through 17, a slight amount of the toner may remain on surface of the photosensitive drum after the transfer of the toner image. Such a residual toner is removed by the cleaning blade 46.

Further, in a continuous printing mode, an insufficiently or excessively charged toner may be transferred onto the transfer belt 33 from the photosensitive drums 53 through 57 of the image forming units 13 through 17. Such a toner transferred onto the transfer belt 33 is removed by the transfer belt cleaning blade 38 therefrom (when the transfer belt 33 moves in a direction indicated by arrows D6 and D8), and is stored in the waste toner tank 39.

<<Test 1>>

Test 1 was performed using the image forming apparatus (i.e., the printer 11) with the above described toners, and using a transparent film (more specifically, an OHP sheet "CG3720" manufactured by Sumitomo 3M Ltd.) of A4-size having a basis weight of 177 g/m$^2$ as the medium 21. A medium conveying speed was set to 200 mm/sec. Adhesion amounts of the toners to the medium 21 (i.e., the transparent film) were adjusted by adjusting the voltages applied to the developing roller 40 and the supply roller 41 (i.e., by controlling the amounts of toners used for development) in each of the image forming units 13 through 17.

In each of the image forming units 14 through 17, the adhesion amount of the toner to the medium 21 was set to 0.5 mg/cm$^2$, and a printing duty was set to 100% (i.e., all of the LEDs of the LED head 47 emitted lights). Further, in the image forming unit 13, the adhesion amount of the white toner to the medium 21 was set to 0.86 mg/cm$^2$ (=0.50 [g/cm$^2$]×0.60 [g/cm$^3$]/0.35 [g/cm$^3$]) considering a difference between the white toner and the color toner in loose apparent density.

The fixing temperature of the fixing unit 20 of the printer 11 was determined as described below. The fixing unit 20 was heated before the medium 21 (i.e., the transparent film) reached the fixing unit 20 and in a state where the toner image was not transferred onto the medium 21. Then, the printer 11 conveyed the medium 21 at the same conveying speed as in the printing operation without performing exposures of the surfaces of the photosensitive drums by the LED heads 47, and the surface temperature Mt of the medium 21 (referred to as a medium surface temperature Mt) was measured immediately after the medium 21 passed the fixing unit 20 using a surface temperature measuring apparatus 60. The surface temperature measuring apparatus 60 is a portable non-contact type thermometer "IRtecP500+Mk2" (manufactured by Eurotron Ltd.) having an emissivity of 0.95. The surface temperature measuring apparatus 60 measured the medium surface temperature Mt at a position where the medium 21 proceeds 20 mm after passing through a nip portion between the fixing roller 48 and the pressure roller 49 as indicated by an arrow D9 in FIG. 1. Temperatures of ten media 21 (i.e., the transparent films) were measured, and an average of the temperatures was determined. As a result, the medium surface temperature Mt was 85° C. when the surface temperature of the fixing roller 48 was 155° C.

Figures 2A, 2B:
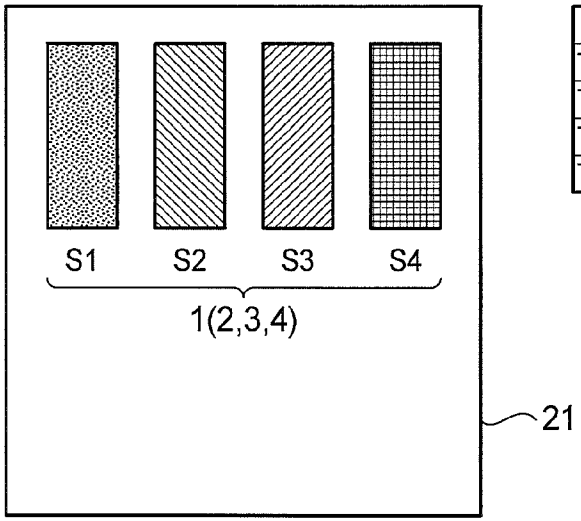
FIG. 2A is a schematic view for illustrating test patterns used in measurement of haze values.
FIG. 2B shows toners used for forming respective sections of the test patterns shown in FIG. 2A.

Next, test patterns 1, 2, 3 and 4 shown in FIG. 2A were printed on the medium 21. The test patterns 1 and 2 were formed by transferring the color toner image onto the medium 21 (i.e., the transparent film), and the test patterns 3 and 4 were formed by transferring the white toner image onto the medium 21 (i.e., the transparent film) and transferring the color toner image onto the white toner image as described below. Each of the test patterns 1, 2, 3 and 4 had four sections S1, S2, S3 and S4 respectively formed using toners shown in FIG. 2B.

More specifically, the sections S1, S2, S3 and S4 of the test pattern 1 were respectively formed by transferring white (W), yellow (Y), magenta (M) and cyan (C) toner images onto the medium 21 (i.e., the transparent film). A printing duty of each of the white, yellow, magenta and cyan toner images was 100%. Further, the toner images were fixed to the medium 21.

As shown in FIG. 2B, the sections S1, S2, S3 and S4 of the test pattern 2 were respectively formed of black (K), red (R), green (G) and blue (B) toner images. The black toner image was formed by transferring a black toner image onto the medium 21 at a printing duty of 100%. The red toner image was formed by transferring a yellow toner image onto the medium 21 at a printing duty of 100%, and transferring a magenta toner image onto the yellow toner image at a printing duty of 100%. The green toner image was formed by transferring a yellow toner image onto the medium 21 at a printing duty of 100%, and transferring a cyan toner image onto the yellow toner image at a printing duty of 100%. The blue toner image was formed by transferring a magenta toner image onto the medium 21 at a printing duty of 100%, and transferring a cyan toner image onto the magenta toner image at a printing duty of 100%. Further, the black, red, green and blue toner images were fixed to the medium 21.

The sections S2, S3 and S4 of the test pattern 3 were formed by transferring a white (W) toner image onto the medium 21 at a printing duty of 100%, and respectively transferring yellow (Y), magenta (M) and cyan (C) toner images onto the white (W) image at printing duties of 100%. Further, the white image and the yellow, magenta and cyan toner images were fixed to the medium 21. The section S1 of the test pattern 3 was a blank section.

The sections S1, S2, S3 and S4 of the test pattern 4 were formed by transferring a white (W) toner image onto the medium 21 at a printing duty of 100%, and respectively transferring black (K), red (R), green (G) and blue (B) toner images onto the white toner image at printing duties of 100%. The formations of the red (R), green (G) and blue (B) toner images were as described with regard to the test pattern 2. Further, the white image and the black, red, green and blue toner images were fixed to the medium 21.

Haze values at the sections S1, S2, S3 and S4 of each of the test patterns 1, 2, 3 and 4 were measured using a haze meter "NDH-2000" (manufactured by Nippon Denshoku Industries Co., Ltd.).

A haze value is defined as a ratio of a diffused light transmittance Td to a total light transmittance Tt, and is calculated by the following equation:

$$\text{Haze value}(\%)=(Td/Tt)\times 100$$

FIG. 3 shows measurement results of the haze values. The measurement results shown in FIG. 3 show that the haze value of the white (W) toner is higher than the haze values of the color toners, i.e., the yellow (Y), magenta (M), cyan (C) and black (K) toners. More specifically, the haze value of the white toner is 88%, and the highest haze value of the color toners (i.e., the yellow, magenta, cyan and black toners) is 70%. Further, when the white color image and the color toner image are printed in a superimposed manner, the haze values of superimposing parts become higher than the haze value of the white toner.

In order to examine an influence of a color of a base sheet beneath the medium 21 with the printed image, evaluation of color reproductivity was performed by laying a black/blue base sheet beneath the medium 21.

More specifically, a black base sheet ("high-quality heavy black paper" manufactured by Kishu Paper Co., Ltd.) having a basis weight of 90 g/m$^2$ was laid, and the medium 21 (i.e., the transparent film) was placed on the black base sheet in such a manner that a surface of the medium 21 opposite to the printing surface faced the black base sheet. Similarly, a blue base sheet ("high-quality heavy blue paper" manufactured by Kishu Paper Co., Ltd.) having a basis weight of 90 g/m$^2$ was laid, and the medium 21 was placed on the blue base sheet in such a manner that a surface of the medium 21 opposite to the printing surface faced the blue base sheet. Then, hues (referred to as printing hues) of the respective sections S1, S2, S3 and S4 of the test patterns 1, 2, 3 and 4 (FIGS. 2A and 2B) on the medium 21 were measured using a measuring apparatus "X-rite 528" (manufactured by X-rite incorporated) with D50 light source at a view field angle of 2 degree.

Figures 5, 6:
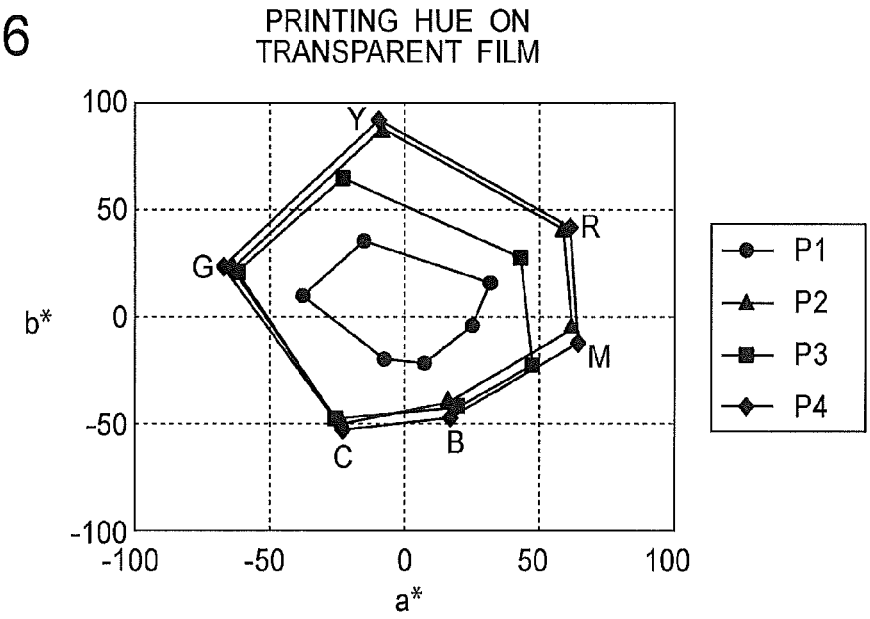
FIG. 5 is a table showing printing hues of the developers printed on the transparent film placed on a blue base sheet in Test 1 which are expressed as values on the (L*, a*, b*) color coordinate system.
FIG. 6 shows the printing hues of the developers printed on the transparent film in Test 1 which are expressed using the (L*, a*, b*) color coordinate system.

FIG. 4 is a table showing measurement results of the printing hues when the medium 21 (i.e., the transparent film) is placed on the black base sheet. FIG. 5 is a table showing measurement results of the printing hues when the medium 21 is placed on the blue base sheet. In FIGS. 4 and 5, the printing hues are expressed as values on a (L*, a*, b*) color coordinate system.

FIG. 6 shows the printing hues expressed using the (L*, a*, b*) color coordinate system. In FIG. 6, points "P1" in the form of black circles indicate printing hues of respective colors of YMCRGB (i.e., yellow, magenta, cyan, red, green and blue) when the medium 21 was placed on the black base sheet and when the color toner image was not superimposed on the white toner image. Points "P2" in the form of black triangles indicate printing hues of respective colors of YMCRGB when the medium 21 was placed on the black base sheet and when the color toner image was superimposed on the white toner image. Points "P3" in the form of black squares indicate printing hues of respective colors of YMCRGB when the medium 21 was placed on the blue base sheet and when the color toner image was not superimposed on the white toner image. Points "P4" in the form of black rhombuses indicate printing hues of respective colors of YMCRGB when the medium 21 was placed on the blue base sheet and when the color toner image was superimposed on the white toner image.

By comparing the points "P1" and the points "P2" or by comparing the points "P3" and the points "P4" in FIG. 6, it is understood that a color reproduction range for respective colors of YMCRGB became wider when the color toner image was superimposed on the white toner image. In other words, excellent color reproductivity was obtained by forming the color toner image so as to be superimposed on the white toner image (see, the points "P2" and "P4"). This is because the white toner image having a higher haze value than the color toner image made the color of the base sheet less visible. In contrast, when the color toner image was not superimposed on the white toner image, the color reproduction range became narrower. Particularly, when the medium 21 was placed on the blue base sheet, the color reproductivity of red (R) was deteriorated, while the color reproductivity of blue (B) was less deteriorated. Therefore, it is understood that, when the color toner image was not superimposed on the white toner image, the reproductivity was largely influenced by the color of the base sheet beneath the medium 21.

Further, chroma was determined as follows:

$$c^*=(a^{*2}+b^{*2})^{1/2}$$

When the medium 21 was placed on the black base sheet, a chroma c* of the black (K) toner image which was not superimposed on the white toner image was 1.3, and a chroma c* of the black (K) toner image superimposed on the white toner image was also 1.3. However, when the medium 21 was placed on the blue base sheet, a chroma c* of the black (K) toner image which was not superimposed on the white toner image was 3.8, and a chroma c* of the black (K) toner image superimposed on the white toner image was 2.9. Therefore, the chroma c* was reduced. In other words, a thicker black color was reproduced by forming the black toner image so as to be superimposed on the white toner image.

As a result, it is understood that, when the color (Y, M, C, K) toner image is printed so as to be superimposed on the white (W) toner image while setting the haze value of the white toner image to be higher than or equal to 88% (i.e., the haze value of the white toner shown in FIG. 3) and setting the haze value of the color toner images to be lower than or equal to 70% (i.e., the highest haze value of the color toners shown in FIG. 3), an image printed on the medium 21 (i.e., the transparent film) is less likely to be influenced by the color of the base sheet and has excellent color reproductivity.

Next, measurement of glossiness was performed at the same measurement points as those of the haze values (FIG. 2A) using a gloss meter "GM-26D" (manufactured by Murakami Color Research Laboratory Co., Ltd.) at an incidence angle of 75 degrees. As a result, the glossiness of any of the color toners (i.e., yellow, magenta, cyan and black) was 35%. That is, excellent glossiness was obtained. In this regard, the glossiness of the color toners (i.e., yellow, magenta, cyan and black) is preferably higher than 25%, and is more preferably higher than 30%.

Next, the medium surface temperature Mt immediately after the medium 21 passed the fixing unit 20 was varied by adjusting the surface temperature of the fixing roller (i.e., the heat roller) 48 of the fixing unit 20.

When the surface temperature of the fixing roller 48 was 145° C., the medium surface temperature Mt immediately after the medium 21 passed the fixing unit 20 was 81° C. In this case, the glossiness of any of the color toners (yellow, magenta, cyan and black) was 30%. That is, excellent glossiness was obtained.

When the surface temperature of the fixing roller 48 was 135° C., the medium surface temperature Mt immediately after the medium 21 passed the fixing unit 20 was 77° C. In this case, the glossiness of any of the color toners (yellow, magenta, cyan and black) was 18%. That is, the glossiness was insufficient.

When the surface temperature of the fixing roller 48 was 175° C., the medium surface temperature Mt immediately after the medium 21 passed the fixing unit 20 was 94° C. The glossiness of any of the color toners (yellow, magenta, cyan and black) was 45%. That is, excellent glossiness was obtained.

When the surface temperature of the fixing roller 48 was 185° C., the medium surface temperature Mt immediately after the medium 21 passed the fixing unit 20 was 99° C. In this case, part of the toner adhered to the surface of the fixing roller 48 at a position where the medium 21 separated from the fixing roller 48 (i.e., a hot offset occurred), and the glossiness of the printed image became irregular (i.e., image failure occurs). That is, the glossiness could not be measured.

Therefore, it is understood that excellent glossiness is obtained when the medium surface temperature Mt of the medium 21 (immediately after the medium 21 passes the fixing unit 20) is in a range from 81° C. to 94° C. When the medium surface temperature Mt of the medium 21 is lower than the softening temperature Ts (° C.) of the color toners, the surfaces of the toner particles do not become uniform. In contrast, when the surface temperature of the medium 21 is higher than or equal to the softening temperature Ts (° C.) of the color toners, the surfaces of the toner particles become uniform, so that the glossiness of the toner adhering to the medium 21 is enhanced. Further, if the medium surface temperature Mt of the medium 21 is higher than the outflow starting temperature Tf (° C.), an internal aggregation force of the toner on the medium 21 is reduced, and part of the toner tends to adhere to the fixing roller 48. In contrast, when the surface temperature of the medium 21 is lower than or equal to the outflow starting temperature Tf (° C.), the toner on the medium 21 is in a rubber state, and can be fixed to the medium 21 without causing a fixing offset.

<<Test 2>>

In Test 2, the white (W) toner was manufactured using the same polyester resin as that of the color toners (black, yellow, magenta and cyan) described in Test 1. In other respects, the white (W) toner is manufactured using the same manner as the white toner used in Test 1. A mean particle diameter of the white toner was 7.0 μm, and a loose apparent density of the white toner was 0.60 g/cm$^3$. This white toner is referred to a "white toner 2". The white toner 2 had the following thermal properties: a softening temperature Tsw of 82° C., an outflow starting temperature Tfw of 97° C., and a melting temperature Tmw of 116° C. The powder hue of the white toner 1 was measured using the same manner as described in Test 1. The measured powder hue expressed in the (L*, a*, b*) color system was as follows: L*=94.51, a*=−1.17, b*=2.78.

A printing test was performed using the white toner 2 instead of the white toner 1 and using the same manner as Test 1 except use of the white toner 2. The medium surface temperature Mt immediately after the medium 21 passed through the fixing unit 20 was set to 85° C. The haze value of the white toner 2 was 70%, i.e., at the same level as the color toners.

Figures 7, 8, 9:
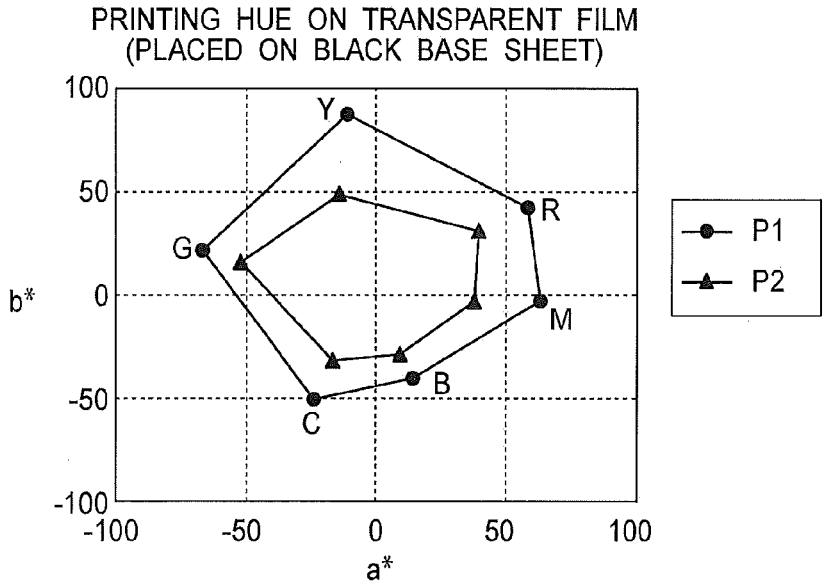
FIG. 7 is a table showing haze values measured in Test 2.
FIG. 8 is a table showing printing hues of developers printed on a transparent film placed on a black base sheet in Test 2 which are expressed as values on the (L*, a*, b*) color coordinate system.
FIG. 9 shows the printing hues of the developer printed on the transparent film placed on the black base sheet in Test 2 which are expressed using the (L*, a*, b*) color coordinate system.

FIG. 7 shows the measurement results of the haze values. FIG. 8 shows the printing hues when the medium 21 (i.e., the transparent film) was placed on the black base sheet. In FIG. 7, the haze values in Test 2 are lower than those in Test 1 (see FIG. 3).

FIG. 9 shows the printing hues expressed using the (L*, a*, b*) color coordinate system. In FIG. 9, points "P1" in the form of black circles indicate printing hues of respective colors of YMCRGB when the medium 21 was placed on the black base sheet and when the color toner image was not superimposed on the white toner image. Points "P2" in the form of black triangles indicate printing hues of respective colors of YMCRGB when the medium 21 was placed on the black base sheet and when the color toner image was superimposed on the white toner image. In Test 2, it is understood that the color reproduction range becomes narrower than in Test 1.

A comparison of Tests 1 and 2 shows that, as the haze value of the white toner image becomes higher, a rate of diffused light increases and influence of the color of the base sheet is reduced. From this result, it is understood that, by forming the color toners on the white toner having haze value higher than or equal to 88% (i.e., higher than or equal to the haze value of the color toner image), the influence of the color of the base sheet can be reduced, and the color reproductivity of the color toners can be enhanced.

<<Test 3>>

In Test 3, the black (K) toner, the cyan (C) toner, the magenta (M) toner and the yellow (Y) toner were manufactured using the same polyester as that of the white toner 1 described in Test 1. In other respects, the color toners (K, C, M, Y) were manufactured in the same manner as Test 1. A mean particle diameter of the each of the color toners was 7.0 μm, and a loose apparent density of each of the color toners was 0.35 g/cm$^3$. These color toners are referred to the black toner 2, the cyan toner 2, the magenta toner 2 and the yellow toner 2.

The black toner 2 had the following thermal properties: the softening temperature Ts of 82° C., the outflow starting temperature Tf of 97° C., and the melting temperature Tm of 146° C. The cyan toner 2 had the following thermal properties: the softening temperature Ts of 82° C., the outflow starting temperature Tf of 97° C., and the melting temperature Tm of 146° C. The magenta toner 2 had the following thermal properties: the softening temperature Ts of 82° C., the outflow starting temperature Tf of 97° C., and the melting temperature Tm of 146° C. The yellow toner 2 had the following thermal properties: the softening temperature Ts of 82° C., the outflow starting temperature Tf of 97° C., and the melting temperature Tm of 146° C. When printing was performed using these color toners, each color toner exhibited glossiness lower than or equal to 11% which was as low as the glossiness of the white toner 1. Therefore, full color printing quality was poor.

<<Test 4>>

Figures 10, 11:
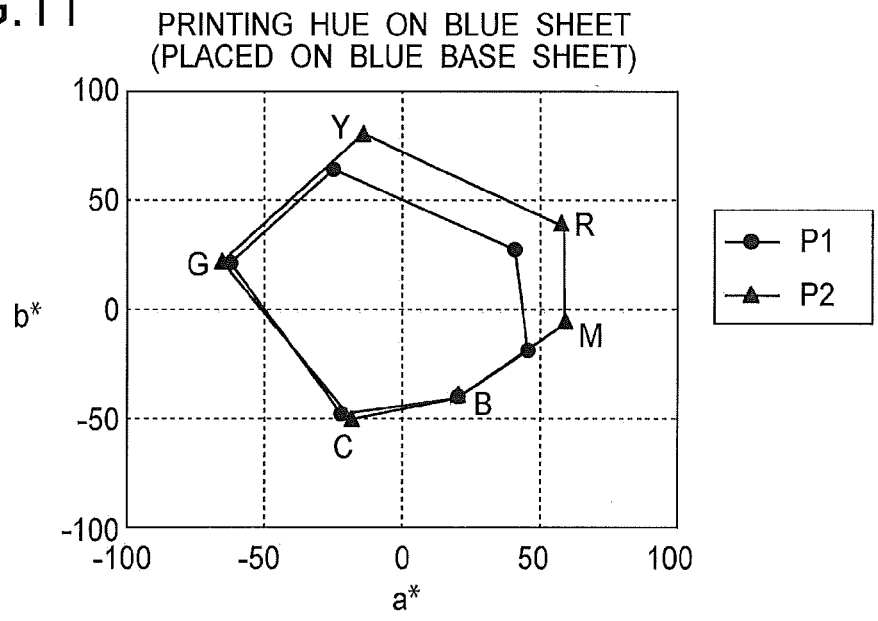
FIG. 10 is a table showing printing hues of developers printed on a blue sheet in Test 4 which are expressed as values on the (L*, a*, b*) color coordinate system.
FIG. 11 shows the printing hues of the developers printed on the blue sheet in Test 4 which are expressed using the (L*, a*, b*) color coordinate system.

In Test 4, a blue sheet ("high-quality heavy blue paper" manufactured by Kishu Paper Co., Ltd.) having a basis weight of 90 g/m$^2$ was used as the medium 21. Other conditions were the same as those of Test 1. When the surface temperature of the fixing roller 48 was 165° C., the medium surface temperature Mt was 85° C. FIG. 10 is a table showing printing hues when the blue sheet is used as the medium 21. FIG. 11 shows the printing hues expressed using the (L*, a*, b*) color coordinate system. In FIG. 11, points "P1" in the form of black circles indicate printing hues of respective colors of YMCRGB when the medium 21 (i.e., the blue sheet) was placed on the blue base sheet and when the color toner image was not superimposed on the white toner image. Points "P2" in the form of black triangles indicate printing hues of respective colors of YMCRGB when the medium 21 was placed on the blue base sheet and when the color toner image was superimposed on the white toner image. As a result, excellent color reproductivity was obtained when the color toner image was superimposed on the white toner image (see, the points P2).

Further, the same tests were performed by replacing the blue sheet (as the medium 21) with a yellow sheet ("high-quality heavy yellow paper" manufactured by Kishu Paper Co., Ltd.) having a basis weight of 90 g/m$^2$, and a red sheet ("high-quality heavy red paper" manufactured by Kishu Paper Co., Ltd.) having a basis weight of 90 g/m$^2$. In either case, excellent color reproductivity was obtained when the color toner image was superimposed on the white toner image.

<<Test 5>>

Tests on color reproductivity were performed using the following toners:

The white (W) toner had the haze value of 91.1%, the softening temperature Tsw of 82° C., the outflow starting temperature Tfw of 99° C., the melting temperature Tmw of 155° C., the glossiness of 10.0, the powder hue of L*=80.1, a*=−2.5 and b*=−3.1.

The black (K) toner had the haze value of 59%, the softening temperature Tsk of 70° C., the outflow starting temperature Tfk of 84° C., the melting temperature Tmk of 101° C., the glossiness of 39.9, the powder hue of L*=14.0, a*=−0.1 and b*=−1.3.

The yellow (Y) toner had the haze value of 59%, the softening temperature Tsy of 70° C., the outflow starting temperature Tfy of 83° C., the melting temperature Tmy of 101° C., the glossiness of 41.0, the powder hue of L*=89.3, a*=−9.9 and b*=−108.2.

The magenta (M) toner had the haze value of 60%, the softening temperature Tsm of 71° C., the outflow starting temperature Tfm of 84° C., the melting temperature Tmm of 102° C., the glossiness of 40.1, the powder hue of L*=38.0, a*=63.2 and b*=7.9.

The cyan (C) toner had the haze value of 59%, the softening temperature Tsc of 70° C., the outflow starting temperature Tfc of 83° C., the melting temperature Tmc of 101° C., the glossiness of 41.0, the powder hue of L*=36.0, a*=2.2 and b*=−50.3.

When the white toner with the haze value of 91.1% was used as described above, excellent color reproductivity was obtained when forming an image on the transparent film. Therefore, it is understood that, by using the white toner whose haze value is higher than or equal to 88%, excellent color reproductivity is obtained when forming an image on the transparent film.

Further, when the color toner with the haze value of approximately 60% was used as described above, high glossiness was obtained and excellent color reproductivity was obtained. Therefore, it is understood that, by using the color toner whose haze value is lower than or equal to 70%, high glossiness is obtained and excellent color reproductivity is obtained.

Accordingly, it is concluded that an image which is less likely to be influenced by the color of the base sheet and which has high glossiness can be obtained by using the white toner whose haze value is higher than or equal to 88% and the color toner whose haze value is lower than or equal to 70%.

Advantages of First Embodiment

As described above, according to the first embodiment, the white toner image has higher haze value than the haze value of the color toner image. Therefore, the color toner image is less likely to be influenced by the color of the base sheet (and also, less likely to be influenced by the color of the medium), and exhibits high glossiness. In other words, by making the haze value of white toner image be relatively high, the color toner image is less likely to be influenced by the color of the base sheet. By making the haze value of the color toner image be relatively low, the color toner image exhibits higher glossiness.

More preferably, when the haze value of the white toner image is higher than or equal to 88% and the haze value of the color toner image is lower than or equal to 70%, the color toner image is less likely to be influenced by the color of the base sheet, and has high glossiness. Further preferably, when the haze value of the white toner image is higher than or equal to the softening temperature Ts (° C.) of the color toner and is lower than or equal to the outflow starting temperature Tf (° C.) of the color toner, the color toner image is less likely to be influenced by the base sheet and exhibits high glossiness, irrespective of the color of the medium.

Second Embodiment

Figure 12:
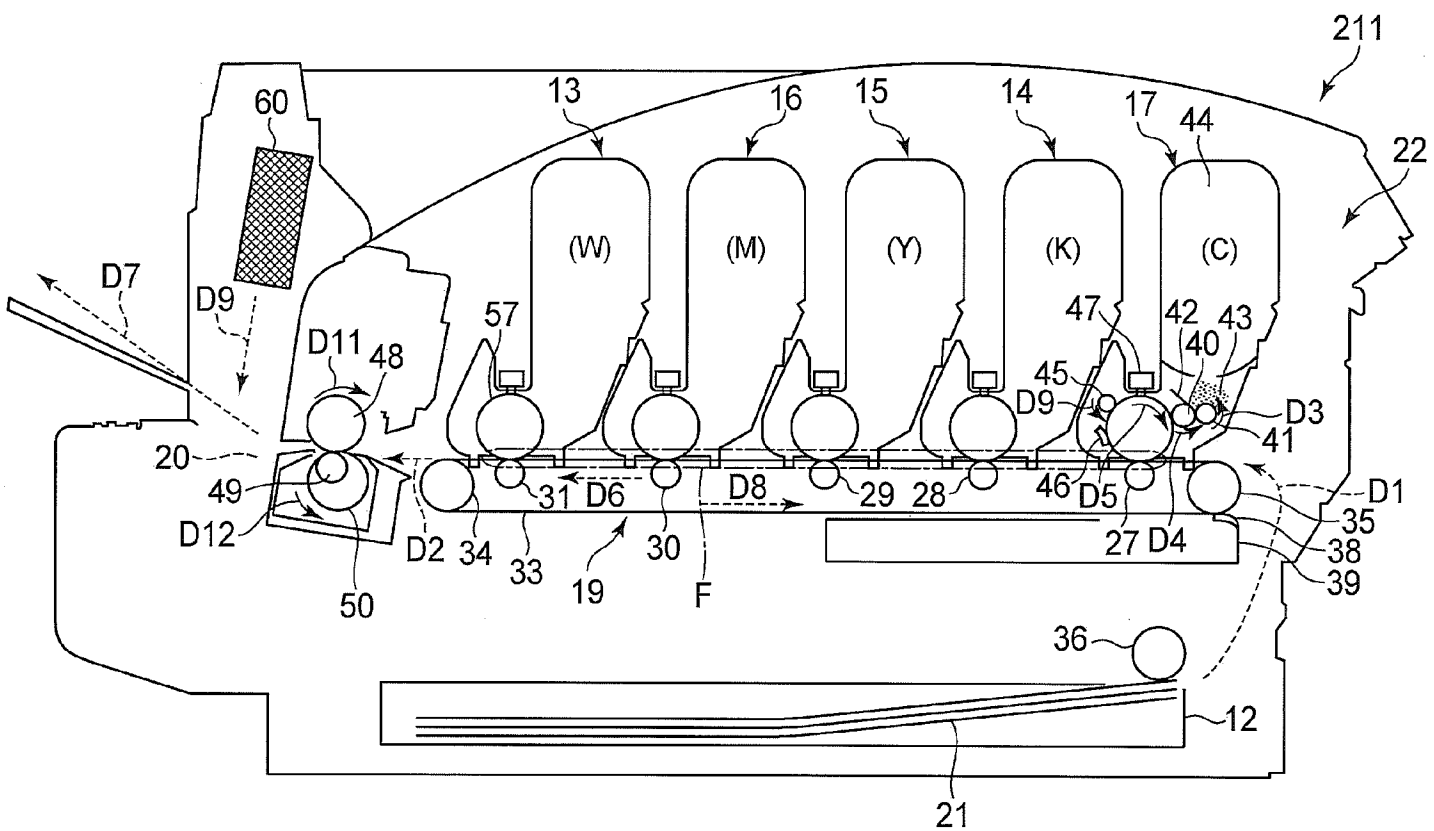
FIG. 12 is a schematic view showing a configuration of a printer as an image forming apparatus according to Embodiment 2 of the present invention.

FIG. 12 is a schematic view showing an image forming apparatus 211 (for example, a printer) according to the second embodiment of the present invention. In FIG. 12, components that are the same as or correspond to those shown in FIG. 1 are assigned the same reference numerals. Unlike the image forming apparatus (i.e., the printer) 11 of the first embodiment, the image forming apparatus 211 of the second embodiment is configured so that the cyan image forming unit 17 is disposed on the upstream end in the medium conveying direction D6, and the white image forming unit 13 is disposed on the downstream end in the medium conveying direction D6.

In other words, in the image forming apparatus 211 of the second embodiment, the cyan image forming unit 17 and the white image forming unit 13 in the image forming apparatus 11 of the first embodiment are replaced with each other. Such a configuration can be obtained by simply replacing the toner cartridges 44 of the white image forming unit 13 and the cyan image forming unit 17 of the first embodiment with each other. In other respects, the image forming apparatus 211 of the second embodiment is the same as the image forming apparatus 11 of the first embodiment.

<<Operation>>

Printing was performed using an iron print sheet (for example, "Pale-Background Transfer Paper CR" manufactured by Quick Art Incorporated) as the medium 21. A printing speed was set to 50 mm/sec. The medium surface temperature Mt was set to 90° C. Other conditions were the same as those of Test 1.

In the printing, the color toner images (cyan, black, yellow, magenta) were formed by the image forming units 17, 14, 15, 16 and are transferred to the medium 21 (i.e., the iron print sheet). Then, the white toner image was formed by the image forming unit 13, and was transferred to the color toner image on the medium 21. Then, the medium 21 was conveyed to the fixing unit 20, and the toner images were heated and pressed. The medium 21 was then ejected outside the image forming apparatus 211.

Thereafter, the medium 21 was placed on a black polyester fabric, and was pressed using a pressing machine with a pressure of 500 kg/cm$^2$ at a temperature of 170° C. for 20 seconds, so that the toner was transferred from the iron print sheet to the fabric. As a result, the toner was fixed to the fabric. Since the white toner image was provided between the fabric and the color toner image, an image with high color reproductivity was obtained.

For comparison, the same printing was performed on the iron print sheet using the image forming apparatus 11 (FIG. 1) of the first embodiment under the conditions described in Test 1. After the printing, the iron print sheet was placed on the fabric, and was pressed using the pressing machine as described above. As a result, the image on the fabric was whitish, since the white toner image was superimposed on the color toner image on the fabric.

<<Advantages>>

The image forming apparatus of the second embodiment is advantageous in printing on the iron print sheet. More specifically, the image forming apparatus of the second embodiment can be obtained by simply replacing the toner cartridges of the image forming apparatus of the first embodiment with each other.

Modifications.

In the first and second embodiments, the printer has been described as an example of the image forming apparatus. However, the present invention is applicable to other apparatus using electrophotography such as a facsimile machine, a copier, a MFP (i.e., Multi-Function Peripherals) or the like.

Further, in the first and second embodiments, the medium 21 such as a printing paper was used. However, it is possible to use other medium having a sheet-like shape on which an image can be formed. For example, it is possible to use a medium such as a film-sheet, a plastic sheet, a label, a fabric or the like having a shape whose thickness is thinner as compared with a surface area.

Furthermore, in the first and second embodiments, the image forming apparatus includes the white image forming unit (i.e., the first image forming unit) and the black, yellow, magenta and cyan image forming units (i.e., the second image forming units). However, the number and the kinds of the second image forming units can be arbitrarily determined.

While the preferred embodiments of the present invention have been illustrated in detail, it should be apparent that modifications and improvements may be made to the invention without departing from the spirit and scope of the invention as described in the following claims.

What is claimed is:

1. An image forming apparatus, comprising:

a first image forming unit configured to form a white developer image on a recording medium using a white developer;

at least one second image forming unit configured to form at least one single-color developer image on said recording medium using at least one single-color developer other than said white developer; and a fixing unit configured to fix said white developer image and said at least one single-color developer image to said recording medium so as to form a white image and at least one single-color image, wherein said white image has a haze value that is higher than that of said at least one single-color image, and wherein said white developer has a softening temperature that is higher than that of said at least one single-color developer.

2. The image forming apparatus according to claim 1, wherein said haze value of said white image is higher than or equal to 88%, and wherein said haze value of each of said at least one single-color image is lower than or equal to 70%.

3. The image forming apparatus according to claim 1, wherein said white developer image and said at least one single-color developer image are superimposed with each other on said recording medium.

4. The image forming apparatus according to claim 1, wherein said first image forming unit forms said white developer image in such a manner that an amount of said white developer per unit area is in a range of 0.8-1.1 mg/cm$^2$, and wherein said at least one second image forming unit forms said at least one single-color developer image in such a manner that an amount of said single-color developer per unit area is in a range of 0.4-0.6 mg/cm$^2$.

5. The image forming apparatus according to claim 1, wherein said first image forming unit forms said white developer image in such a manner that an amount of said white developer per unit area is in a range of 0.9-1.1 mg/cm$^2$, and wherein said at least one second image forming unit forms said at least one single-color developer image in such a manner that an amount of said single-color developer per unit area is in a range of 0.4-0.5 mg/cm$^2$.

6. An image forming apparatus, comprising:

a first image forming unit configured to form a white developer image on a recording medium using a white developer;

at least one second image forming unit configured to form at least one single-color developer image on said recording medium using at least one single-color developer other than said white developer; and a fixing unit configured to fix said white developer image and said at least one single-color developer image to said recording medium so as to form a white image and at least one single-color image, wherein said white developer has a softening temperature that is higher than that of said at least one single-color developer.

7. The image forming apparatus according to claim 6, wherein said white developer image and said at least one single-color developer image are superimposed with each other on said recording medium.

8. The image forming apparatus according to claim 7, wherein said white developer image is formed on said recording medium, and said at least one single-color developer image is formed on said white developer image.

9. The image forming apparatus according to claim 7, wherein said at least one single-color developer image is formed on said recording medium, and said white developer image is formed on said at least one single-color developer image.

10. The image forming apparatus according to claim 6, wherein said recording medium has a conveying direction, and wherein said first image forming unit is disposed on an upstream side of said at least one second image forming unit in the conveying direction of said recording medium.

11. The image forming apparatus according to claim 6, wherein said recording medium has a conveying direction, and wherein said first image forming unit is disposed on a downstream side of said at least one second image forming unit in the conveying direction of said recording medium.

12. The image forming apparatus according to claim 6, further comprising a transfer unit disposed so as to lace said first image forming unit and said at least one second image forming unit, said transfer unit having a belt.

13. The image forming apparatus according to claim 12, wherein said belt has a region facing said first image forming unit and said at least one second image forming unit.

14. The image forming apparatus according to claim 13, wherein said belt has a moving direction, and wherein said first image forming unit is disposed on an upstream side of said at least one second image forming unit in the moving direction of said belt.

15. The image forming apparatus according to claim 14, wherein said belt conveys said recording medium.

16. The image forming apparatus according to claim 13, wherein said belt has a moving direction, and wherein said first image forming unit is disposed on a downstream side of said at least one second image forming unit in the moving direction of said belt.

17. The image forming apparatus according to claim 16, wherein said belt conveys said recording medium.

18. The image forming apparatus according to claim 6, wherein, when said recording medium has a surface temperature Mt (° C.) at said fixing unit, said at least one single-color developer has a maximum softening temperature Tsmax (° C.) and a minimum outflow starting temperature Tfmin (° C.) that satisfy:

$$Ts\max(^\circ\,C.) \leq Mt(^\circ\,C.) \leq Tf\min(^\circ\,C.).$$

19. The image forming apparatus according to claim 6, wherein said first image forming unit forms said white developer image in such a manner that an amount of said white developer per unit area is in a range of 0.8-1.1 mg/cm$^2$, and wherein said at least one second image forming unit forms said at least one single-color developer image in such a manner that an amount of said single-color developer per unit area is in a range of 0.4-0.6 mg/cm$^2$.

20. The image forming apparatus according to claim 6, wherein said first image forming unit forms said white developer image in such a manner that an amount of said white developer per unit area is in a range of 0.9-1.1 mg/cm$^2$, and wherein said at least one second image forming unit forms said at least one single-color developer image in such a manner that an amount of said single-color developer per unit area is in a range of 0.4-0.5 mg/cm$^2$.

21. The image forming apparatus according to claim 6, wherein said white developer includes a white toner containing at least a binder resin and a white coloring agent.

22. The image forming apparatus according to claim 21, wherein said white coloring agent contains metallic oxide.

23. The image forming apparatus according to claim 22, wherein said metallic oxide contains titanium oxide.

24. The image forming apparatus according to claim 6, wherein said at least one single-color image has a glossiness that is higher than 30%.

25. The image forming apparatus according to claim 1, wherein an outflow starting temperature of said white developer is higher than an outflow starling temperature of said at least one single-color developer.

26. The image forming apparatus according to claim 6, wherein an outflow starting temperature of said white developer is higher than an outflow starting temperature of said at least one single-color developer.

* * * * *